US009222314B2

(12) United States Patent
Mahmood et al.

(10) Patent No.: US 9,222,314 B2
(45) Date of Patent: Dec. 29, 2015

(54) SHALE DRILL PIPE

(71) Applicant: Vallourec Drilling Products USA, Inc., Houston, TX (US)

(72) Inventors: Mazhar Mahmood, Houston, TX (US); Marta Lafuente, Houston, TX (US); Scott Granger, Houston, TX (US)

(73) Assignee: Vallourec Drilling Products USA, Inc., Houston, TX (US)

( * ) Notice: Subject to any disclaimer, the term of this patent is extended or adjusted under 35 U.S.C. 154(b) by 278 days.

(21) Appl. No.: 13/751,866

(22) Filed: Jan. 28, 2013

(65) Prior Publication Data

US 2014/0209394 A1 Jul. 31, 2014

(51) Int. Cl.

| | |
|---|---|
| ***F16L 9/00*** | (2006.01) |
| ***E21B 17/042*** | (2006.01) |
| ***E21B 17/00*** | (2006.01) |

(52) U.S. Cl.

CPC ..... *E21B 17/042* (2013.01); *E21B 17/00* (2013.01); *Y10T 29/49826* (2015.01)

(58) Field of Classification Search

CPC ..... E21B 17/042; F16L 15/001

USPC ..... 138/177, 178, DIG. 11; 285/333–335, 285/390

See application file for complete search history.

(56) References Cited

U.S. PATENT DOCUMENTS

| | | | | |
|---|---|---|---|---|
| 3,080,179 | A * | 3/1963 | Huntsinger | 285/45 |
| 3,784,238 | A * | 1/1974 | Chance et al. | 285/288.1 |
| 4,256,518 | A * | 3/1981 | Bolton et al. | 148/521 |
| 4,273,159 | A * | 6/1981 | Bolton et al. | 138/109 |
| 4,987,961 | A * | 1/1991 | McNeely, Jr. | 175/320 |
| 5,562,312 | A * | 10/1996 | Carlin | 285/288.4 |
| 5,743,301 | A * | 4/1998 | Winship | 138/109 |
| 5,853,199 | A * | 12/1998 | Wilson | 285/45 |
| 6,244,631 | B1 * | 6/2001 | Payne et al. | 285/333 |
| 6,681,875 | B2 * | 1/2004 | Larsson et al. | 175/320 |
| 2002/0054972 | A1 | 5/2002 | Charpentier et al. | |
| 2005/0189147 | A1 * | 9/2005 | Williamson et al. | 175/320 |
| 2014/0006227 | A1 * | 1/2014 | Griggs et al. | 705/28 |
| 2014/0145432 | A1 * | 5/2014 | Yang et al. | 285/332 |

OTHER PUBLICATIONS

International Search Report issued Nov. 5, 2014 in PCT/IB2014/000073.

"Specification for Drill Pipe ANSI/API spec 5DP" API Energy, http://www.gaslinepipe.com/wp-content/uploads/2013/06/API-Spec-5DP-2009-Specification-for-Drill-Pipe.pdf, Aug. 2009, pp. 1-124.

* cited by examiner

*Primary Examiner* — Patrick F Brinson

(74) *Attorney, Agent, or Firm* — Oblon, McClelland, Maier & Neustadt, L.L.P

(57) ABSTRACT

A drill pipe for oil and gas drilling comprises two tool joints and a main portion between the tool joints, with two upsets adjacent to the tool joints, and a central section between the upsets. The outer diameter of the central section of the main portion is less than the outer diameter of the main portion upsets, and the outer diameter of the central section of the main portion is between 4" and 4½".

17 Claims, 6 Drawing Sheets

--- 4" DP

---- 4 1/2" DP

SHALE DRILL PIPE

CROSS-REFERENCE TO RELATED APPLICATION

This application relates to the disclosures of U.S. Pat. No. 7,210,710, issued on May 1, 2007, the entire contents of which are incorporated herein by reference.

BACKGROUND

The present invention relates to a drill pipe, a tubular drill string component for unconventional oil and gas drilling with 6⅛" to 6¾" production hole sizes. Unconventional oil and gas drilling is commonly referred to as shale drilling.

Shale drilling is becoming increasingly developed as hydraulic fracturing, or fracking, continues to make unconventional recoveries more efficient and economical. Shale drilling typically requires the drilled hole to include a vertical profile followed by a horizontal profile such that the well trajectory maximizes exposure to the production zone. A typical Bakken well profile would have a kick-off point between the vertical and horizontal profiles located at about 10,000 feet Measured Depth (MD) followed by another 10,000 feet MD of horizontal section. Typical build rates from vertical to horizontal are about 10 degrees dogleg or higher, increasing the well tortuosity and hence the cyclical stresses on the drill pipe.

Issues associated with conventional drilling are exacerbated in the case of shale drilling. Drilling horizontal wells is more challenging as the drilled lengths increase, both vertically and horizontally. Challenges include managing ECD (Equivalent Circulating Density), providing directional control towards the trailing end of horizontal section, efficient hole cleaning, and dealing with inefficiencies due to drill string buckling and increased tubular wear.

Horizontal drilling with a longer horizontal section tends to increase hole cleaning challenges, and can cause the drill string to get stuck if drilling parameters and mud properties are not closely monitored and adjusted in real time.

Difficult drilling conditions lead drill pipes used for unconventional drilling to have a shorter drilling tubular life than drill pipes used for conventional drilling. A typical shale well horizontal section is drilled with the drill string in compression, increasing contact between the pipe and the formation or casing, especially in curved portions, leading to wear. The life span of drill pipes used on shale wells is significantly reduced by 1-2 years from the typical 4-5 year life span of drill pipes used for conventional drilling. Drill pipes in shale wells thus require more frequent repairs, and more frequent replacement than conventionally used drill pipes, hence also driving the costs higher.

Currently used drill pipes typically have a 4" outside diameter (OD), following standards described in the API SPEC 5DP: Specification for Drill Pipe, the entire content of which is incorporated herein by reference. Buckling and mid-section wear are two main issues associated with existing drill pipes, which are related to drill pipe diameter selection.

SUMMARY

A drill pipe for unconventional oil and gas drilling is disclosed herein and an exemplary embodiment comprises first and second tool joints, with the first and second tool joint having identical outside and inside diameters, a main portion between the first and second tool joints, with upsets adjacent to the first and second tool joints, and a central section between the upsets. An outer diameter of the central section of the main portion is less than an outer diameter of the main portion upsets, and the ratio of the outer diameter of the central section of the main portion to the outer diameter of the main portion upsets is selected for a range of given hole sections from 6⅛" to 6¾".

BRIEF DESCRIPTION OF THE DRAWINGS

The characteristics and advantages of an exemplary embodiment are set out in more detail in the following description, made with reference to the accompanying drawings.

DETAILED DESCRIPTION OF THE PREFERRED EMBODIMENTS

It is an object and feature of an exemplary embodiment described herein to provide a shale drill pipe with an optimum outer diameter to minimize buckling and mid-section wear, and optimize drilling efficiencies. An exemplary embodiment increases drill string buckling resistance and allows higher flow rates. An exemplary drill pipe may in addition have a zone to increase shale drill pipe life expectancy.

One advantage of an exemplary shale drill pipe described herein is the ability to apply more weight on bit, which yields a greater rate of penetration, without experiencing pipe buckling. Another advantage of the exemplary shale drill pipe described herein is an improvement in hole cleaning efficiency by decreasing bottoms up time as well as number of bottoms-up cycles to clean the well. The exemplary drill pipe can be handled with standard handling equipment (elevator). These and other objects, advantages, and features of the exemplary shale drill pipe described herein will be apparent to one skilled in the art from a consideration of this specification, including the attached drawings.

Figure 1:
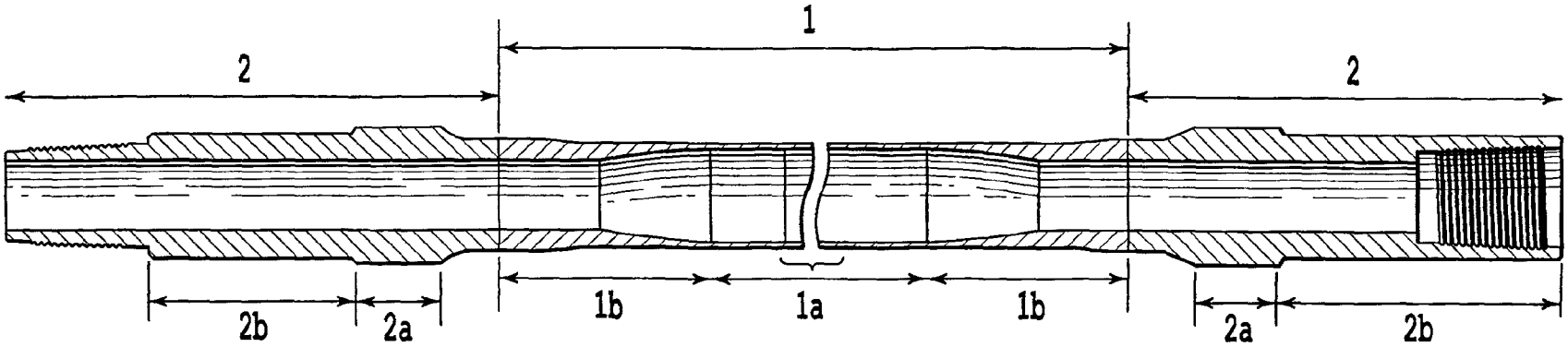
FIG. 1 depicts a schematic cross-sectional view of a first variant of an exemplary embodiment.
Figure 2:
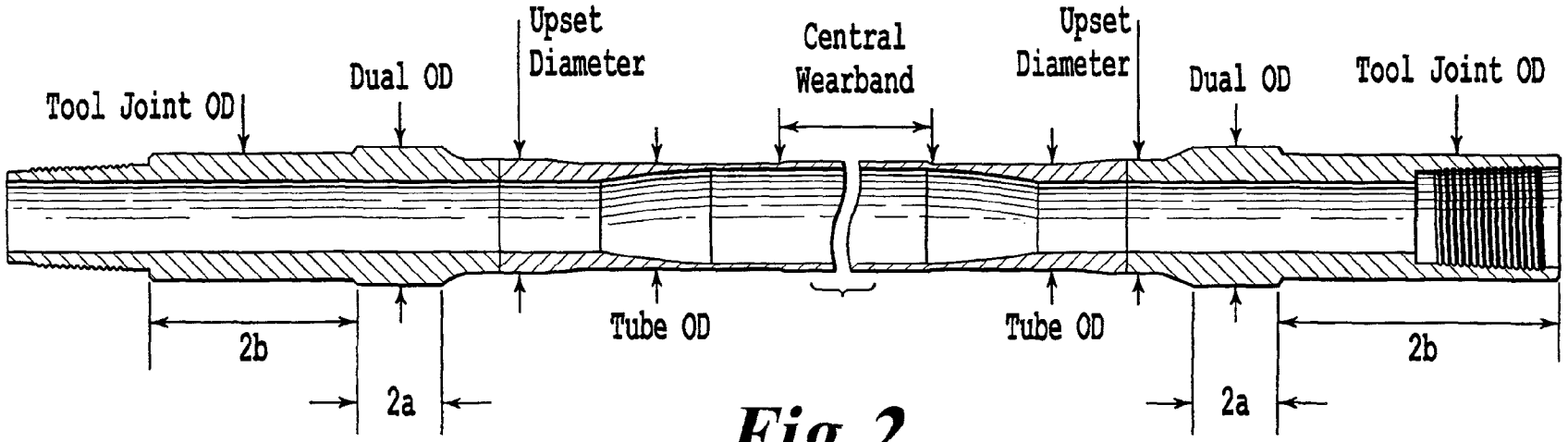
FIG. 2 depicts a schematic cross-sectional view of a second variant of an exemplary embodiment.

Referring to FIG. 1, a shale drill pipe element includes first and second tool joints (2) with an inner diameter (ID). The drill pipe also includes a main portion (1) comprising a central section (1*a*) and upsets (1*b*) near the tool joints. As shown in FIGS. 1 and 2 the tool joints may have a dual OD: a proximal portion (2*a*) and distal portion (2*b*), with the proximal portion outer diameter greater than the tool joint distal portion outer diameter. The pipe main portion has a wall thickness defined by its OD and ID. A ratio R is defined between the tube main section OD and upset OD. FIG. 1 describes a first embodiment of the present invention.

Figure 3:
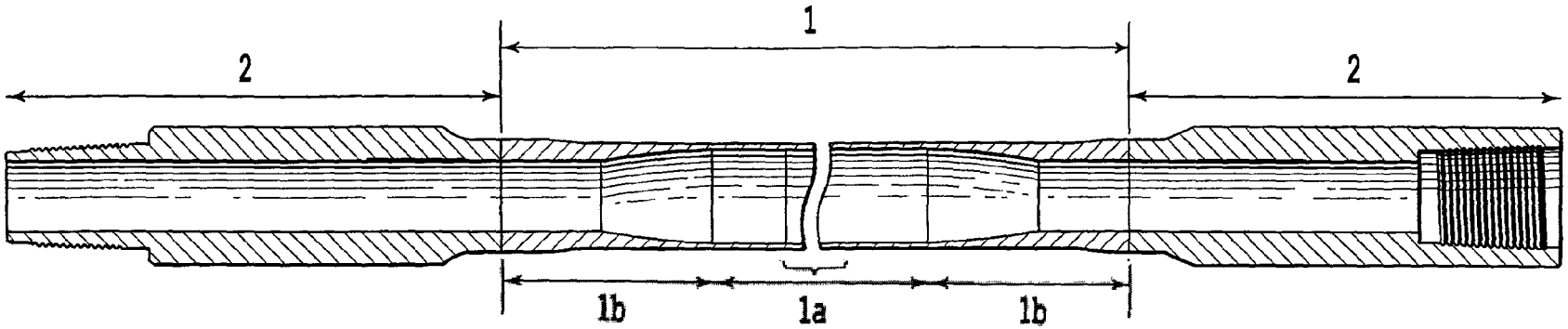
FIG. 3 depicts a schematic cross-sectional view of a third variant of an exemplary embodiment.
Figure 4:
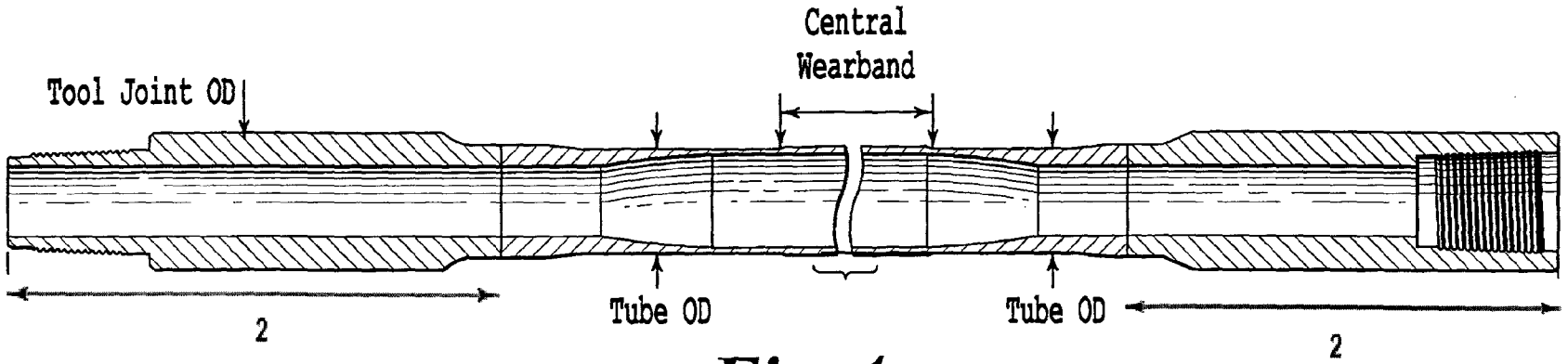
FIG. 4 depicts a schematic cross-sectional view of a fourth variant of an exemplary embodiment.

FIG. 2 describes a second embodiment of the present invention, which differs from the first embodiment in that it may have a central wearband, described below. FIG. 3 describes a third embodiment of the present invention, which differs from the first embodiment in that it may not have a dual OD feature described below. FIG. 4 describes a fourth embodiment of the present invention, which differs from the third embodiment in that it may have a central wearband. As shown in FIGS. 1-4 exemplary embodiments of the present invention may have a constant inner diameter throughout the tool joints (2), with an increase in inner diameter between the tool joint diameter and the central section of the tube main portion (1*a*), the increase in inner diameter taking place in the upset regions (1*b*).

Figure 5:
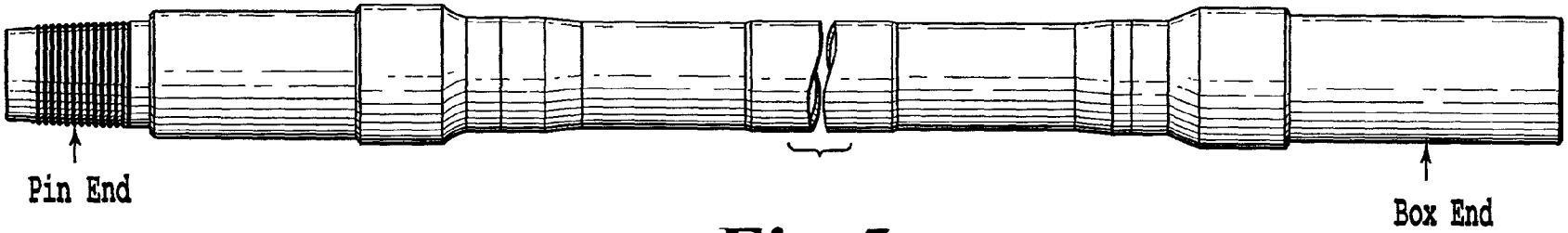
FIG. 5 depicts a schematic view of a second variant of an exemplary embodiment.

As shown in FIG. 5, tool joints are threaded connections. The pipe element comprises one pin connection on one end, and one box connection on its other end, allowing the pipe elements to be connected with one other and to form a string.

Tool joints used (2) have double shoulder connections such as VAM® Express connections, which offers a higher torque and a longer service life with a slimmer profile than other tool joints. Tool joint outer and inner diameters vary based on the application and connection used. Connections may have different sizes to ensure compatibility with different tube combinations of outside and inside diameters. For instance, there are several sizes of VAM® Express connections, such as VAM® Express VX39 and VAM® Express VX40 which are compatible with different tubes combinations of outside diameters and inside diameters.

The drill pipe main section and tool joints are manufactured separately. Tool joints are forged then welded onto the main section using friction welding. Upsets are required to be forged on the main section to achieve a thickness which ensures the same strength between the tube and the weld zone. A minimum upset outer diameter (OD) is thus based on the yield strength of the weld, such that the total tensile strength of the weld zone is at least greater than the total tensile strength of the tube body. A maximum upset OD is determined such that the upset zone is compatible with handling equipment.

In an exemplary embodiment of the present invention the drill pipe length may be Range 2 or Range 3, corresponding to 31.5 feet nominal length or 45 feet nominal length, respectively.

In an exemplary embodiment of the present invention an acceptable range for tube wall thickness is 0.26-0.43".

In an exemplary embodiment of the present invention the outer diameter of the pipe main section is greater than 4" and smaller than 4½", while the inner diameter of the pipe central section is between 3.826" to 3.240".

In an exemplary embodiment of the present invention the outer diameter of the upsets is greater than or equal to the tube main section OD, and is smaller than the tool joint OD. Thus, the outer diameter of the upsets (1*b*) is greater than 4" and smaller than 5".

In an exemplary embodiment of the present invention for a drill pipe element with a main section outer diameter such that 4"<OD<4½", the ratio R of the outer diameter of the central section of the main portion (1*a*) to the outer diameter of the upsets of the main portion (1*b*) is such that 0.9<=R<=0.99.

In a preferred embodiment the tube main section wall thickness is 0.330", based on market needs.

In a preferred embodiment which uses a double shoulder connection such as a VAM® Express VX 39 connection the outer diameter of the tool joints is 4⅞" and the inner diameter of the tool joints is 3". In a preferred embodiment which uses a double shoulder connection such as a VAM® Express VX 40 connection the outer diameter of the tool joints is 5¼" and the inner diameter of the tool joints is 3".

Figure 6:
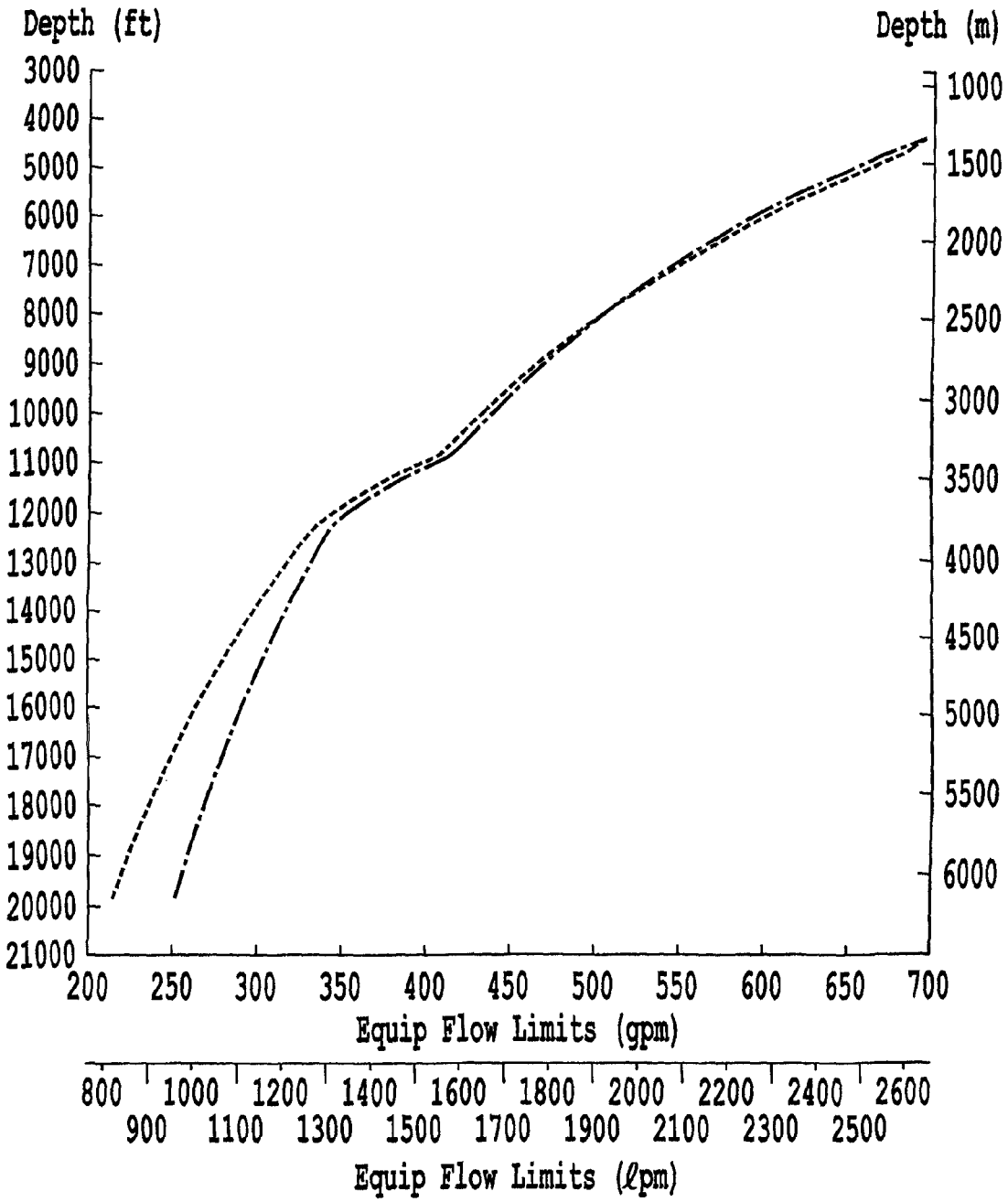
FIG. 6 depicts equipment limited flow rate profiles for currently used pipe geometries in a 6¾" drill hole.

It is beneficial to increase equipment flow limits since this provides better drilling efficiency, and better hole cleaning efficiency. Referring to FIG. 6, the chart compares equipment limited flow rates for pipes with different ODs in a 6¾" hole size. FIG. 6 displays equipment flow limits for 4" OD pipes and 4½" OD pipes. The 4" OD pipe allows a larger equipment limited flow rate than the 4½" OD pipe. To a person of ordinary skill in the art at the time of the invention a linear relation between pipe OD and equipment limited flow rate may have been expected. As such, a person of ordinary skill in the art at the time of the invention could have expected a pipe with OD between 4" and 4½" to yield an equipment limited flow rate between the equipment limited flow rate of the 4" OD pipe and that of the 4½" OD pipe. In other words, a person of ordinary skill in the art at the time of the invention could have expected that increasing OD led to lower equipment limited flow rates and lower efficiencies.

Figure 7:
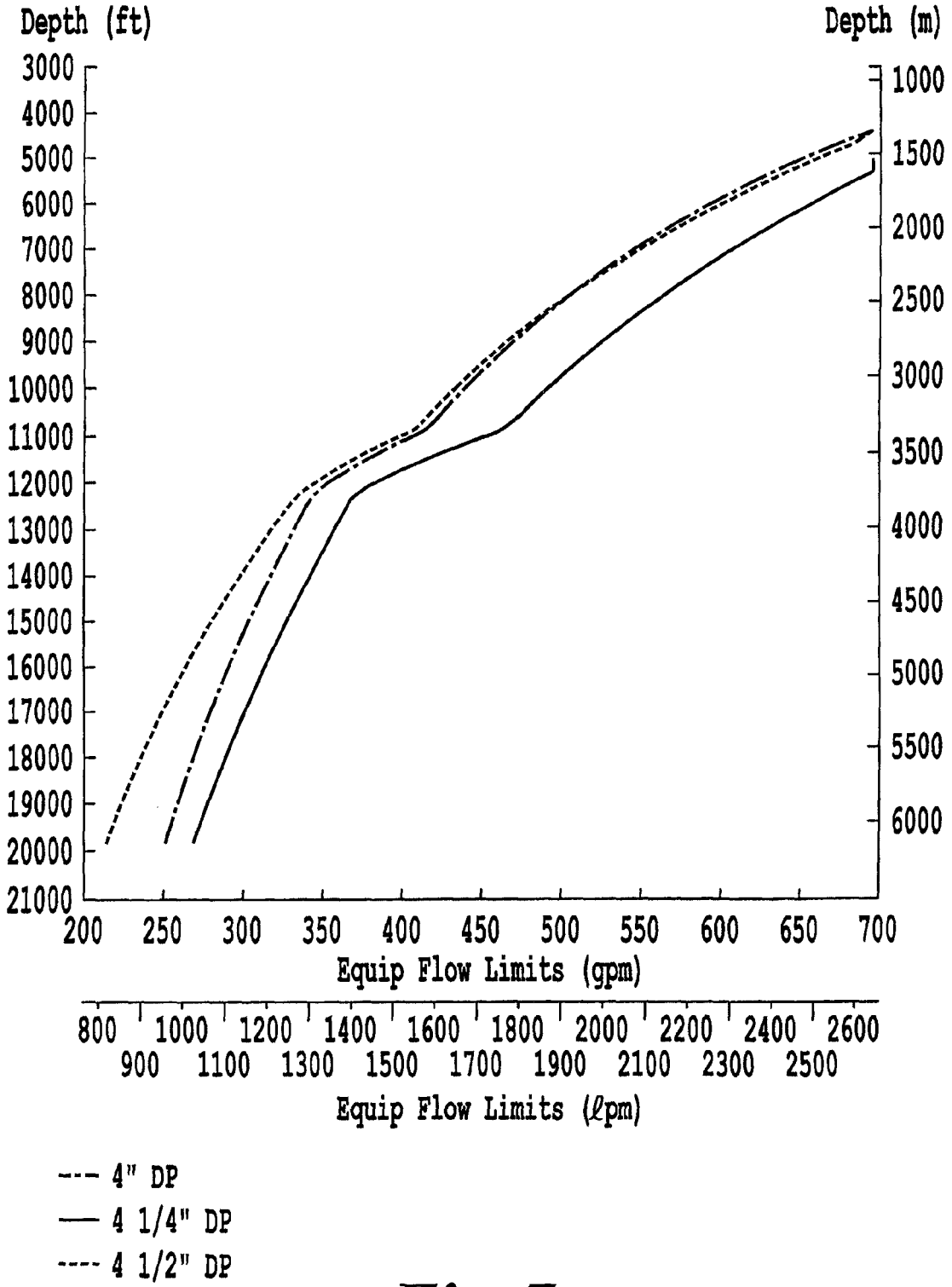
FIG. 7 depicts equipment limited flow rates for currently used pipe geometries and an exemplary embodiment of the present invention in a 6¾" drill hole.
Figure 8:
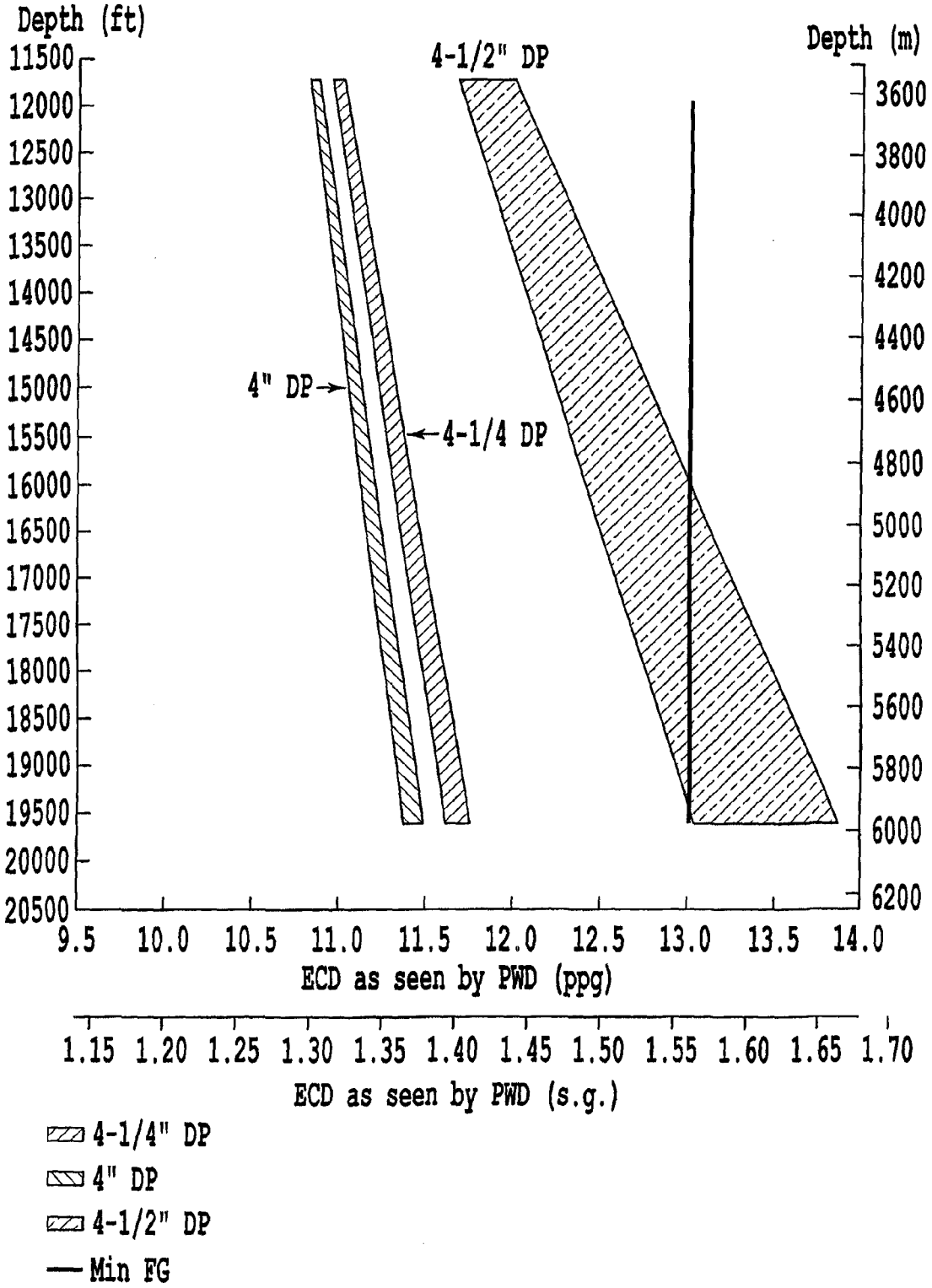
FIG. 8 depicts equivalent circulating densities for currently used pipe geometries and an exemplary embodiment of the present invention in a 6¾" drill hole.

However, referring to FIG. 7 Applicants show that a 4¼" pipe allows in fact a greater limited flow rate than a 4" OD pipe. In other words, the 4¼" OD equipment limited flow rate performance unexpectedly does not fall between that of the 4" OD pipe and the 4 ½" OD pipe. Referring to FIG. 8, flow rate sensitivity profiles are shown for 4" OD, 4½" OD and 4½" OD pipes in a 6¾" OD hole. From FIG. 8, for a 4½" OD pipe at depths greater than 16,000 feet, the equivalent circulating density levels are greater than the acceptable safe working limit. In an exemplary embodiment, the equivalent circulating density in a drill pipe is no greater than 13 ppg. In an exemplary embodiment, between a depth of 5000 feet and a depth of 19,000 feet, an equipment limit flow rate for the drill pipe is at least 250 gpm.

Data presented in FIGS. 6 and 7 results from mathematical modeling shown to be accurate through field experience for several wells.

In a preferred embodiment, the outer diameter of the central section is 4¼" with a central section inner diameter of 3.590".

In a preferred embodiment, the outer diameter of the upsets is 4½" with an upset inner diameter the same as the tool joint inner diameter.

In a preferred embodiment R=0.944 to within standard engineering tolerances in the field, which corresponds to the preferred 4¼" main section tube OD and a 4½" main section upset OD.

In a preferred embodiment, the drill pipe provides the tensile capacity to safely perform drilling and tripping operations. In a preferred embodiment the drill pipe is manufactured with S-135 grade steel (with a yield strength of 135 ksi), as determined by tensile load requirements.

To improve pipe resistance to buckling, an increase in stiffness can be obtained by increasing the pipe OD. By increasing the shale drill pipe OD from 4" to 4¼" the pipe stiffness increases and the SDP can handle up to 18% more weight on bit (WOB) than a standard 4" pipe, without buckling during rotary drilling operations. A higher WOB yields a greater rate of penetration, and overall more efficient drilling operations. When tripping or drilling, buckling is likely to occur as a result of compressive axial loading, which can further increase torque and drag. Buckled pipe may create a lock up in severe cases, thus making it very difficult to transfer mechanical energy to the drill bit. While increasing pipe OD is beneficial for buckling and wear, increasing pipe ID is also beneficial to increase the flow rate, reduce hydraulic pressure losses, and increase hole cleaning and drilling efficiency. For each hole size there is a drill pipe size that gives the lowest hydraulic pressure loss. For a 6¾" hole size with an exemplary embodiment of the shale drill pipe described herein, using a 4¼" OD and a central section ID of 3.590" a 150 psi improvement in stand pipe pressure is obtained, with a 12.5% increase in flow rate, compared to a currently used 4" OD pipe, with standpipe pressure defined as the sum of all pressure drops throughout the drill string and between the drill string and the hole. Drill pipe elements with larger inner diameters yield smaller hydraulic pressure losses. Although increasing tool joint ID would have some effect on the pressure loss, the overall benefit is insignificant and hard to quantify.

Despite changes in OD and ID for a given production size hole, all holes must be cleaned to the same standard, which requires optimizing drill pipe design such that cleaning flow rate is at least as large as required to meet the standard.

For a given flow rate, a drill pipe with a larger OD will be more efficient with respect to hole cleaning, since the annular velocity of fluids traveling uphole between the drill pipe and the bore hole wall will increase. The increase in annular velocity improves cleaning efficiency by up to 20% in terms of number of bottoms up and time to clean the well (a bottom up is achieved when materials from the bottom of the drill hole reach the surface) as well as circulating hours for each bottom up, such that the desired level of cleaning is reached. Mathematical modeling shows the number of bottoms up decreases from 6.3 to 5.4 to clean a hole, and circulating hours decrease from 6.7-10 hrs to 5.8-8 hrs, depending on flow rates. Flow rates can be selected to obtain a constant annular velocity and the same level of hole cleaning for all holes, without pushing the equivalent circulating density beyond safe working limits.

Referring to FIG. 3 and FIG. 4, in a variant of the preferred embodiment, intended for a 6¾" hole section, the outer diameter (OD) of the tool joints is constant. In this first variant of the preferred embodiment, the outer diameter of the tool joints is 5¼". A connection such as a VAM® Express VX40 can be used. This embodiment provides the capability of having the drill string fished out as needed with a standard overshot.

Referring to FIG. 1 and FIG. 2, in a variant of the preferred embodiment intended for 6 ⅛" hole sections, the tool joints have a dual OD: a proximal portion (2*a*) and distal portion (2*b*), with the proximal portion outer diameter greater than the tool joint distal portion outer diameter. The dual OD feature increases tool joint life and increases elevator capacity without decreasing drill pipe hydraulic performance. The dual OD feature also improves tube stand-off, which decreases side-wall forces and the associated tube wear. In a preferred embodiment the outer diameter of the tool joint proximal portion is 5¼", while the outer diameter of the tool joint distal portion is 4⅞". A connection such as a VAM® Express VX 39 can be used. This second variant of the preferred embodiment is compatible with a standard overshot and standard handling equipment for fishing operations in 6⅛" hole sizes. The first variant of the preferred embodiment is not compatible with 6⅛" hole sized equipment.

Referring to FIGS. 2 and 4, to extend pipe life wearbands can be positioned at mid-section of the pipe, such that the wearbands take more OD wear thereby extending the time before the pipe needs replacement.

In an exemplary embodiment, a central section of the drill pipe main portion has special metal thermal spray metallic coating wearbands, such as WearSox—trade mark of WearSox, which are more resistant to friction wear than the pipe body material. In a preferred embodiment, WearSox is applied over an area 8 feet in length located at the pipe mid-section, with a 1/16" to ⅛" thickness. Use of such a central wearband can increase tube service life by 200% or more in typical shale formations.

In an exemplary embodiment, hardbanding is used on the tool joints. In contrast with hardbanding on the pipe midsection, tool joint hardbanding is a hot welding process which protects casing and tool joint from wear. Standard hardbanding for tool joints is typically 3" long and can be applied to the tool joint OD or in a groove. In an exemplary embodiment at least one tool joint has a hardbanding section with an outer diameter greater than or equal to an outer diameter of a tool joint by 3/16".

In another embodiment, an internal plastic coating (IPC) is applied on the drill pipe interior to protect against corrosion, pitting, and corrosion fatigue. IPC can improve hydraulic efficiency. IPC may be liquid, solid, or an epoxy.

Because many possible embodiments may be made of the invention without departing from the scope thereof, it is to be understood that all matter herein set forth or shown in the accompanying drawings is to be interpreted as illustrative and not in a limiting sense.

The invention claimed is:

1. A drill pipe for oil and gas drilling through a hole section, comprising:

a first tool joint with a threaded portion, said first tool joint having a first tool joint outer diameter, a second tool joint with a threaded portion, said second tool joint having a second tool joint outer diameter, a main portion between the first and second tool joints, said main portion having a main portion outer diameter, wherein the main portion outer diameter is smaller than the first tool joint outer diameter and the main portion outer diameter is smaller than the second tool joint outer diameter, and wherein the main portion outer diameter is strictly greater than 4" but strictly smaller than 4½".

2. The drill pipe as in claim 1, wherein the outer diameter of the main portion is greater than 4⅛" but smaller than 4⅜".

3. The drill pipe as in claim 1, wherein the outer diameter of the main portion is 4¼".

4. The drill pipe as in claim 1, wherein the main portion includes upsets adjacent to the first and second tool joints, and a central section between the upsets.

wherein a ratio of an outer diameter of the central section of the main portion to an outer diameter of the upsets of the main portion is between 0.9 and 0.99.

5. The drill pipe as in claim 4, wherein the ratio of the outer diameter of the central section of the main portion to the outer diameter of the upsets of the main portion is about 0.944.

6. The drill pipe as claimed in claim 1, wherein the first and second tool joints have a proximal portion and a distal portion, with an outer diameter of the proximal portion of the tool joints greater than an outer diameter of the distal portion of the tool joints.

7. The drill pipe as claimed in claim 6, wherein the tool joints have a proximal portion outer diameter between 5" and 5¼", and a distal portion outer diameter between 5 ¼" and 4 7/16".

8. The drill pipe as claimed in claim 1, wherein the drill pipe further comprises at least one wear band with an outer diameter greater than the main portion outer diameter, located at a mid-section of the drill pipe and extending between 6 and 12 feet.

9. The drill pipe as claimed in claim 8, wherein the outer diameter of the wear band is greater than the main portion outer diameter by 1/16" to ⅛".

10. The drill pipe as in claim 1, wherein the first and second tool joints are double shoulder tool joints.

11. The drill pipe as in claim 1, wherein the drill pipe main portion comprises an S-135 grade material.

12. The drill pipe as in claim 4, wherein an inner diameter of the central section of the main portion is 3.590", and an inner diameter of a remaining portion of the drill pipe is 3".

13. A method for manufacturing an oil and gas drill pipe, comprising:

forming a first and a second tool joint and a main portion between the first and second tool joints, wherein an outer diameter of the main portion is smaller than a first tool joint outer diameter and the main portion outer diameter is smaller than a second tool joint outer diameter, the forming further comprising:

selecting an outer diameter of the main portion strictly greater than 4" but strictly smaller than 4 ½".

14. The method as in claim 13, wherein the outer diameter of the main portion is greater than 4 ⅛" but smaller than 4 ⅜".

15. The method as in claim 13, wherein the outer diameter of the main portion is 4 ¼".

16. The method as in claim 13, wherein said forming further comprised forming upsets adjacent to the first and second tool joints, and forming a central section between the upsets, and wherein said selecting further comprises selecting a ratio of an outer diameter of the central section of the main portion to an outer diameter of the upsets of the main portion between 0.9 and 0.99.

17. The method as in claim 16, wherein the ratio of the outer diameter of the central section of the main portion to the outer diameter of the upsets of the main portion is about 0.944.

* * * * *